US006076590A

United States Patent [19]

Ford et al.

[11] Patent Number: 6,076,590

[45] **Date of Patent: *Jun. 20, 2000**

[54] SEGMENTED GARAGE DOOR AND HINGES

[75] Inventors: Jim S. Ford, Lawrence; Loren D. Mock, Baldwin City, both of Kans.

[73] Assignee: Garage Door Group, Inc., Lawrence, Kans.

[ * ] Notice: This patent is subject to a terminal disclaimer.

[21] Appl. No.: 09/346,198

[22] Filed: Jul. 1, 1999

Related U.S. Application Data

[63] Continuation-in-part of application No. 08/982,271, Dec. 1, 1997, Pat. No. 5,921,307.

[51] Int. Cl.[7] ..... E05D 15/10

[52] U.S. Cl. ..... 160/229.1; 160/40; 16/366; 16/387

[58] Field of Search ..... 160/201, 229.1, 160/232, 40, 199, 206; 16/97, 104, 223, 221, 366, 387

[56] References Cited

U.S. PATENT DOCUMENTS

| | | | |
|---|---|---|---|
| 126,464 | 5/1872 | Kohler . | |
| 1,626,844 | 5/1927 | Kuhn . | |
| 2,214,653 | 9/1940 | Barlough . | |
| 2,233,351 | 2/1941 | Rowe . | |
| 2,263,995 | 11/1941 | Katulski . | |
| 2,300,265 | 10/1942 | Siess . | |
| 2,331,340 | 10/1943 | Mosher . | |
| 2,549,301 | 4/1951 | Ferrell et al. . | |
| 2,557,716 | 6/1951 | Allee . | |
| 2,655,683 | 10/1953 | McKee et al. | 160/201 |
| 2,831,537 | 4/1958 | Ritter . | |
| 2,951,533 | 9/1960 | Lucas et al. . | |
| 2,952,313 | 9/1960 | Stroup . | |
| 3,000,048 | 9/1961 | Harsch . | |
| 3,103,967 | 9/1963 | Gaschen . | |
| 3,148,724 | 9/1964 | Chieger et al. . | |
| 3,302,690 | 2/1967 | Hurd . | |
| 3,319,697 | 5/1967 | Krohn . | |
| 3,376,913 | 4/1968 | Clapsaddle | 160/201 |
| 3,608,613 | 9/1971 | Halliwell . | |
| 3,648,755 | 3/1972 | Thiele . | |
| 3,891,021 | 6/1975 | Geoffrey . | |
| 3,894,571 | 7/1975 | Hinchliff . | |
| 3,941,180 | 3/1976 | Thill . | |
| 3,967,671 | 7/1976 | Stanley et al. . | |
| 4,119,133 | 10/1978 | Wolf . | |
| 4,269,253 | 5/1981 | Ziegler . | |
| 4,290,233 | 9/1981 | Hubbard . | |

(List continued on next page.)

*Primary Examiner*—David M. Purol
*Attorney, Agent, or Firm*—Hovey, Williams, Timmons & Collins

[57] ABSTRACT

A segmented door (10, 107) such as a garage door includes a plurality of adjacent door panels (12, 14, 104, 106) pivotally interconnected for movement between a pivoted position and an alignment position. The edge walls (30, 34, 190, 192) on opposed sides of the juncture (26, 110) between adjacent panels (12, 14, 104, 106) present mated, arcuate surfaces. The preferred door (10, 107) includes a hinge bracket (38, 112) mounted to one panel (12, 104) and a hinge brace (40, 116) mounted to an adjacent panel (14, 106) configured to present hinge pin holes (66, 74, 126, 142) in registration with a hinge pin (42, 128) received therein, adjacent the first panel (12, 104) and spaced from the juncture (26, 110) between the panels (12, 14, 104, 106). The bracket (38, 112) and brace (40, 116) are configured for gradually closing the gap between the edge walls (30, 34, 190, 192) and so that the edge walls (30, 34, 192, 190) slide by one another to prevent pinching in the juncture (26, 110) during movement from the pivoted to the aligned position. In one embodiment, the hinge pin (128) is held inside the panel (104) and behind the panel interior wall (132). Further, an end hinge (102) is used at the ends (158) of the panels (104, 106). The end hinge (102) has a hinge base (150) and a hinge foot (156) with pivot pins (160, 164) extending from the hinge foot (156) into pivotal engagement with the ends (158) of the panels (104, 106). Preferably, the pivot pins (160, 164) are pivotally received by end brackets (168, 170) mounted on the ends (158) of the panels (104, 106).

19 Claims, 5 Drawing Sheets

U.S. PATENT DOCUMENTS 4,379,480 4/1983 Kempel et al. .
4,436,136 3/1984 Downey, Jr. .
4,518,026 5/1985 Otto et al. .
4,644,725 2/1987 Schijf .
4,718,472 1/1988 Hörmann .
4,736,785 4/1988 Seuster .
4,771,816 9/1988 Clay, Jr. .
4,854,365 8/1989 Juneau .
4,893,666 1/1990 Hörmann .
4,924,932 5/1990 Esnault .
4,930,561 6/1990 Clay ..... 160/229.1
4,989,660 2/1991 Wagner .
5,002,114 3/1991 Hörmann .
5,016,700 5/1991 Wegner et al. .
5,042,556 8/1991 Ruiter .
5,054,536 10/1991 Leist et al. .
5,133,108 7/1992 Esnault .
5,148,850 9/1992 Urbanick .
5,163,493 11/1992 Kraeutler .
5,170,832 12/1992 Wagner .
5,235,724 8/1993 Perrin et al. .
5,359,812 11/1994 Mayfield .
5,365,993 11/1994 Jellá .
5,394,924 3/1995 Rejc .
5,396,735 3/1995 Dietrich .
5,495,640 3/1996 Mullet et al. .
5,522,446 6/1996 Mullet et al. .
5,562,141 10/1996 Mullet et al. .
5,564,164 10/1996 Jellá .
5,566,740 10/1996 Mullet et al. .
5,622,012 4/1997 Schjif .
5,626,176 5/1997 Lewis, Jr. et al. .
5,630,459 5/1997 Martin .
5,669,431 9/1997 Druzynski et al. .
5,782,283 7/1998 Kendall .
5,913,352 6/1999 Scates et al. ..... 160/229.1
5,921,307 7/1999 Ford et al. ..... 160/229.1

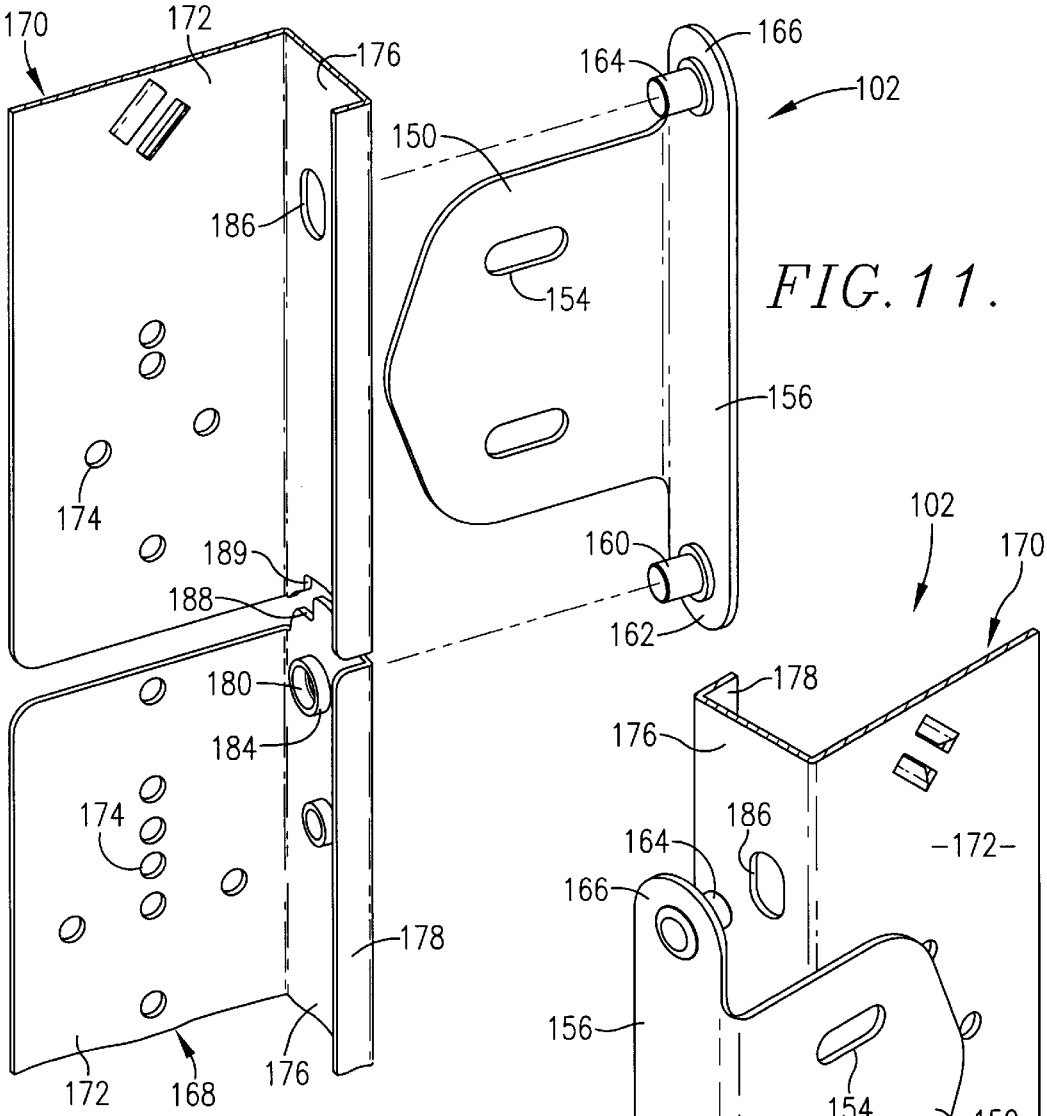
FIG. 11.
FIG. 12.
FIG. 13.
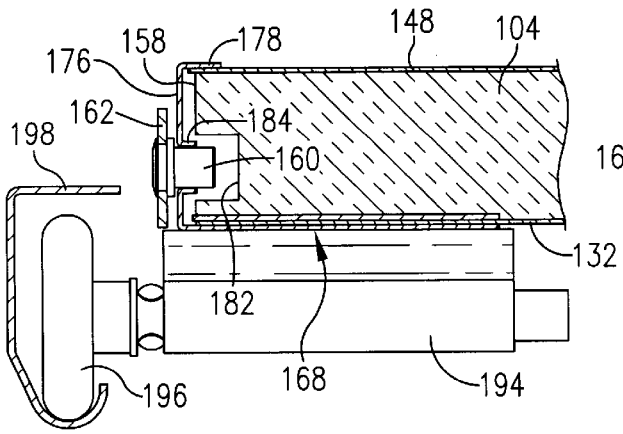

SEGMENTED GARAGE DOOR AND HINGES

RELATED APPLICATIONS

This application is a continuation-in-part of and claims priority on previously filed and U.S. Application filed Dec. 1, 1997 and having application Ser. No. 08/982,271 now U.S. Pat. 5,921,307

BACKGROUND OF THE INVENTION

1. Field of the Invention

The present invention is concerned with the field of segmented doors such as garage doors. More particularly, the invention is concerned with such a door having a hinge bracket mounted to one panel and a hinge brace mounted to an adjacent panel configured to present hinge pin holes in registration and having a hinge pin received therein and spaced from the juncture between the panels. The bracket and brace are configured for gradually closing the gap between the edge walls so that the edge walls slide by one another to prevent pinching in the juncture during movement from the pivoted to the aligned position.

2. Description of the Prior Art

Segmented doors, such as multi-panel garage doors, have presented a hazard in that the juncture between adjacent panels presents a pinching hazard as the doors close and the panels shift to an aligned position. Prior art attempts to solve this problem have met with only limited success, sometimes presenting mechanical complexity or uneconomical designs, for example.

SUMMARY OF THE INVENTION

The present invention solves the prior art problems mentioned above and provides a distinct advance in the state of the art. In particular, the segmented door hereof is mechanically simple and economical to manufacture and install.

The preferred segmented door includes a plurality of adjacent door panels, a hinge bracket mounted to one panel, a hinge brace mounted to an adjacent panel, and a hinge pin received in respective, registered, hinge pin holes defined in the bracket and brace. The adjacent panels present mated, arcuate edge walls. The bracket and brace are configured to position the hinge pin adjacent the one panel and spaced from the juncture so that the gap between the edge walls closes gradually and so that the edge walls slide by one another during movement from the pivoted position to the aligned position. In preferred forms, the door panels present interior faces spaced from respective exterior faces with the hinge pin positioned therebetween. Other preferred aspects of the present invention are disclosed herein.

The invention is also directed toward preferred hinges for use with the segmented door. A central hinge preferably has a hinge bracket with opposed hinge legs extending transversely from a mounting shoe which is used to mount the hinge to a first door panel. The hinge bracket is also provided with outwardly extending positioning flanges and positioning feet to position and secure the hinge bracket. The central hinge also has a hinge brace with a J-shaped hinge arm extending substantially perpendicularly to the hinge legs and terminating in a cylindrical loop which is positioned between the opposed hinge legs. Alternatively, the hinge bracket only has one hinge leg, and the hinge arm extends substantially parallel to the hinge leg.

Another hinge is used on the ends of the door panels. The end hinge includes a hinge base for mounting to an upper panel, and a hinge foot for positioning adjacent the panel ends. Two pivot pins extend from the hinge foot for pivotally engaging the ends of the panels.

In a preferred embodiment, the hinge also includes end brackets for mounting on the end of the panels. The end brackets define openings for receiving the pivot pins. One of the openings preferably comprises a slot shaped opening. The end hinge is also provided with a guide roller mount which mounts over one of the end brackets. It is contemplated by the present invention that the end hinge and central hinge are used in combination to join adjacent panels of a segmented door.

The invention is further directed to a seal between adjacent door panels. The seal preferably has a dove tail connector defining a compression slit for insertion in a dove tail connection slot in the edge of one of the panels, preferably an upper panel.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein:

FIG. 11 is an exploded, fragmentary, perspective inner side view of the edge hinge assembly of FIG. 7;

FIG. 12 is an exploded, fragmentary, perspective outer side view of the edge hinge assembly of FIG. 7, and FIG. 13 is a horizontal cross sectional view of the edge hinge assembly of FIG. 7 and taken along line 13—13 in FIG. 7.

DETAILED DESCRIPTION

Figure 2:
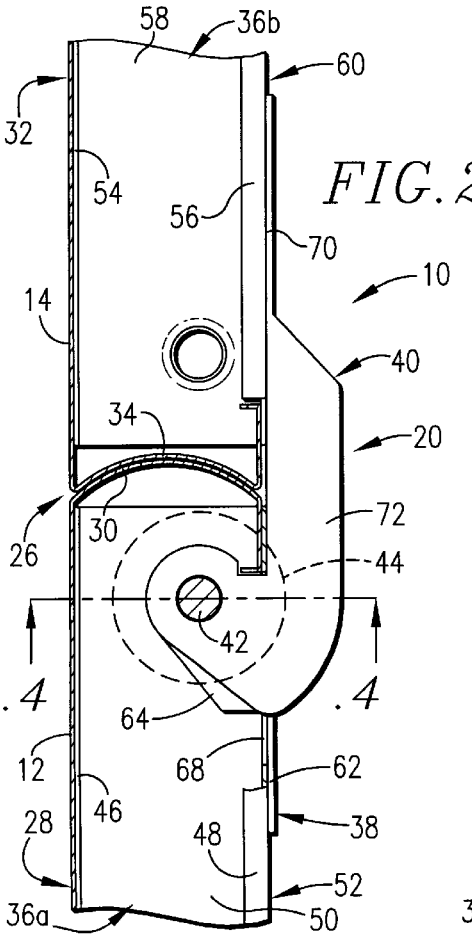
FIG. 2 is a partial, side elevational view in partial section of the preferred segmented door in accordance with the present invention showing adjacent door panels in the aligned position.
Figure 3:
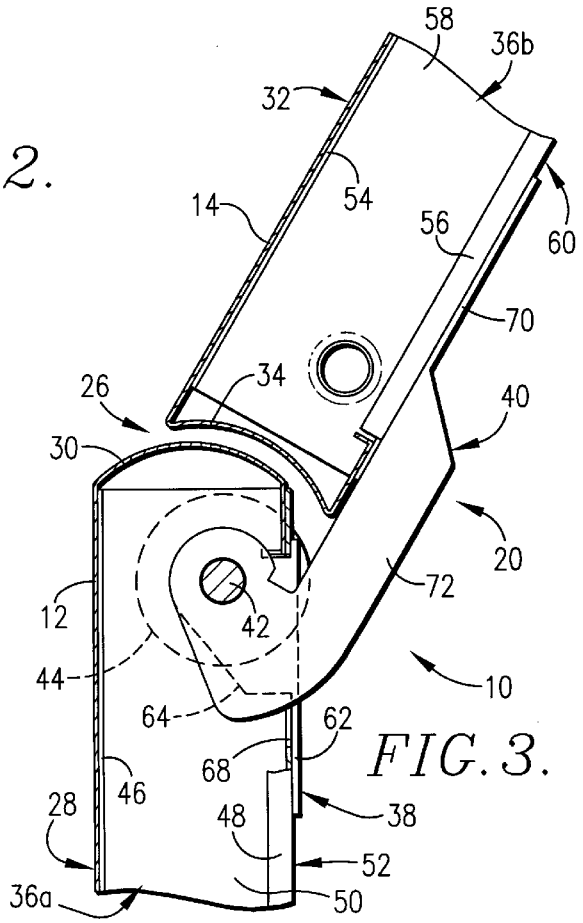
FIG. 3 is a view similar to FIG. 2 but showing the panels in the pivoted position.
Figures 5, 6:
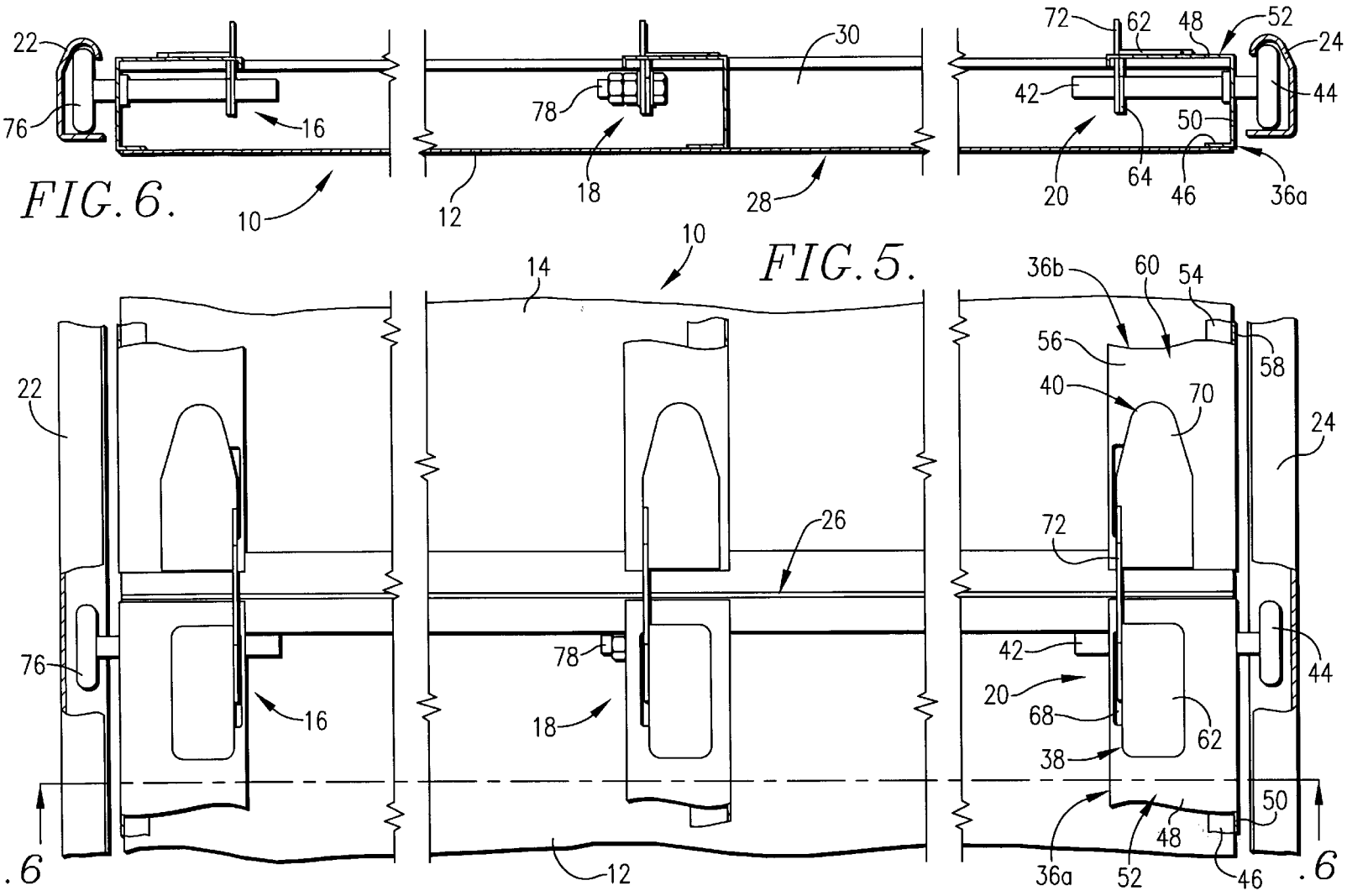
FIG. 5 is a fragmentary rear view of the door of FIG. 2.
FIG. 6 is a sectional view taken along line 6—6 of FIG. 5.

Turning initially to FIGS. 2, 3 and 6, preferred segmented door 10 in accordance with the present invention includes a plurality of adjacent door panels such as first panel 12 and second panel 14 along with a plurality of hinge assemblies including left assembly 16, center assembly 18 and right assembly 20. Door 10 is guided and supported by left guide track 22 and right guide track 24.

As best viewed in FIGS. 2 and 3, adjacent, first and second panels 12, 14 present juncture 26 therebetween. First panel 12 presents exterior face 28 and includes arcuate edge wall 30 preferably in the form of a convex radius. Similarly, second panel 14 presents exterior face 32 and includes arcuate, edge wall 34, preferably in the form of a concave radius configured to mate with and engage convex edge wall 30 as illustrated in FIG. 2. With this design, panels 12 and 14 present a coped joint adding structural strength to door 10 when the panels are aligned and providing a generally tighter joint, less subject to infiltration.

Figure 4:
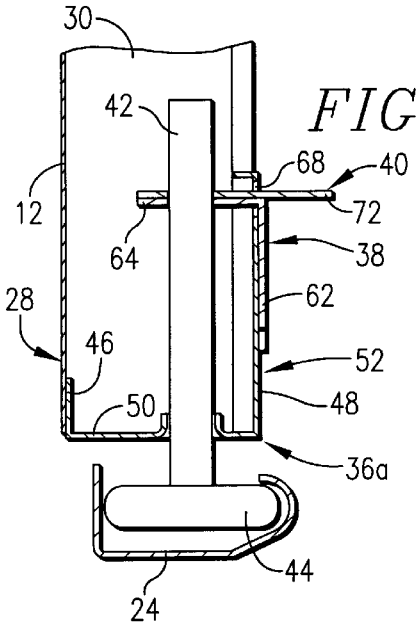
FIG. 4 is a partial sectional view taken along line 4—4 of FIG. 2.
Figure 1:
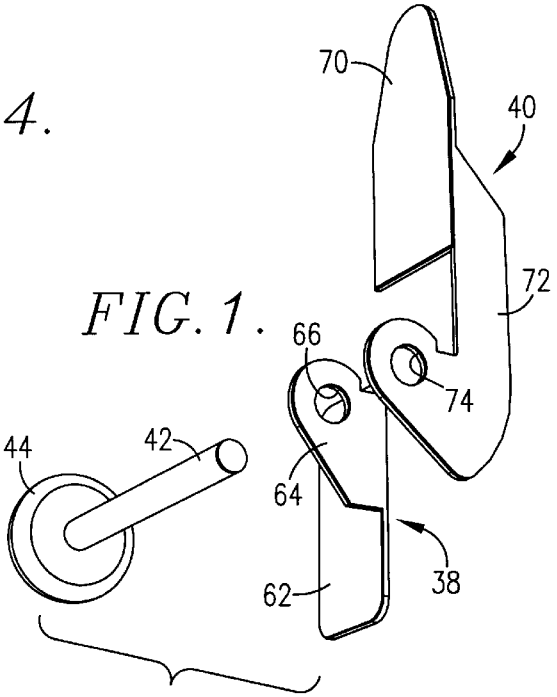
FIG. 1 is an exploded view of the preferred hinge assembly in accordance with the present invention.

Right hinge assembly 20 includes lower mounting channel 36*a*, upper mounting channel 36*b*, hinge bracket 38, hinge brace 40 and hinge pin 42 in the form of a guide roller axle with guide roller 44 attached to one end thereof as illustrated in FIG. 1, for example. Lower mounting channel 36*a* includes short flange 46 attached to the inboard surface of first panel 12, long flange 48 and web 50 therebetween. Long flange 48 presents interior face 52. Similarly, upper mounting channel 36*b* includes short flange 54 attached to the inboard surface of second panel 14, long flange 56 and web 58 therebetween. Long flange 56 presents interior face 60. As best viewed in FIGS. 2, 3 and 5, channels 36*a,b* are positioned on opposed sides of juncture 26 and configured so that interior faces 52 and 60 are substantially contiguous when panels 12 and 14 are in the aligned position.

As best viewed in FIG. 1, metal hinge bracket 38 includes mounting shoe 62 and integral hinge leg 64 extending transversely therefrom with first hinge pin hole 66 defined therethrough. Bolts, sheet metal screws or rivets mount shoe 62 to interior face 52 of mounting channel 36*a* with hinge leg 64 extending through slot 68 in order to position first hole 66 between interior face 52 and exterior face 28.

Metal hinge brace 40 includes mounting plate 70 and integral J-shaped hinge arm 72 with second hinge pin hole 74 defined therethrough adjacent the distal end thereof and substantially parallel to the hinge leg. Bolts, sheet metal screws or rivets attach mounting plate 70 to interior face 60 so that hinge arm 72 spans juncture 26 and so that second hole 74 registers with first hole 66.

The hinge arm 72 is substantially perpendicular to the mounting plate 70, and the hinge leg 64 is substantially perpendicular to the mounting shoe 62. The hinge leg 64 and hinge arm 72 are also substantially perpendicular to the interior face 52. Both the hinge arm 72 and the hinge leg 64 extend, parallel to each other, through the slot 68 provided on the interior face 52 of the channel 36*a*. Thus, the holes 66, 74 and the hinge pin 42 are held inside the panel, that is inside the channel 36*a* which forms part of the panel. Further, the hinge pin is closer to the lower panel than to the upper panel.

Hinge pin 42 is received through holes 66 and 74 and pivotally couples panels 12 and 14 as illustrated in FIGS. 2 and 3. Guide roller 44 is received in right guide track 24.

Left hinge assembly 16 is the same as right hinge assembly 20 except that left-right reversed and having guide roller 76 received in left guide track 22 as shown in FIGS. 5 and 6. Center hinge assembly 18 is also the same as right hinge assembly 20 except that the hinge pin is in the form of bolt 78. A plurality of hinge pin assemblies are provided for each juncture between adjacent panels of door 10.

It will be appreciated that some door panels include an inboard wall and an outboard wall with a space therebetween which may be hollow, or filled with insulation or other filler. In these circumstances, the inboard wall presents an interior face and mounting channels are not needed. That is, the hinge brackets and hinge braces are mounted to the interior face of the inboard wall in order to position the hinge pin between the interior and exterior faces and spaced from the juncture.

In operation, FIG. 3 illustrates door panels 12 and 14 in the pivoted position with panel 14 at an angle relative to panel 12. This represents the position of the door panels during opening and closing of door 10.

As door 10 closes, panel 14 pivots about hinge pin 42 toward the aligned position illustrated in FIG. 12 in which both panels are substantially in the same plane. As panel 14 pivots toward the aligned position, the gap between edge walls 30 and 34 gradually closes as walls 30, 34 slide by one another. Any object present in juncture 26 is pushed outwardly because of the relative sliding action between walls 30 and 34. In this way, juncture 26 does not present a pinching hazard, which has been a problem in the prior art.

Figure 7:
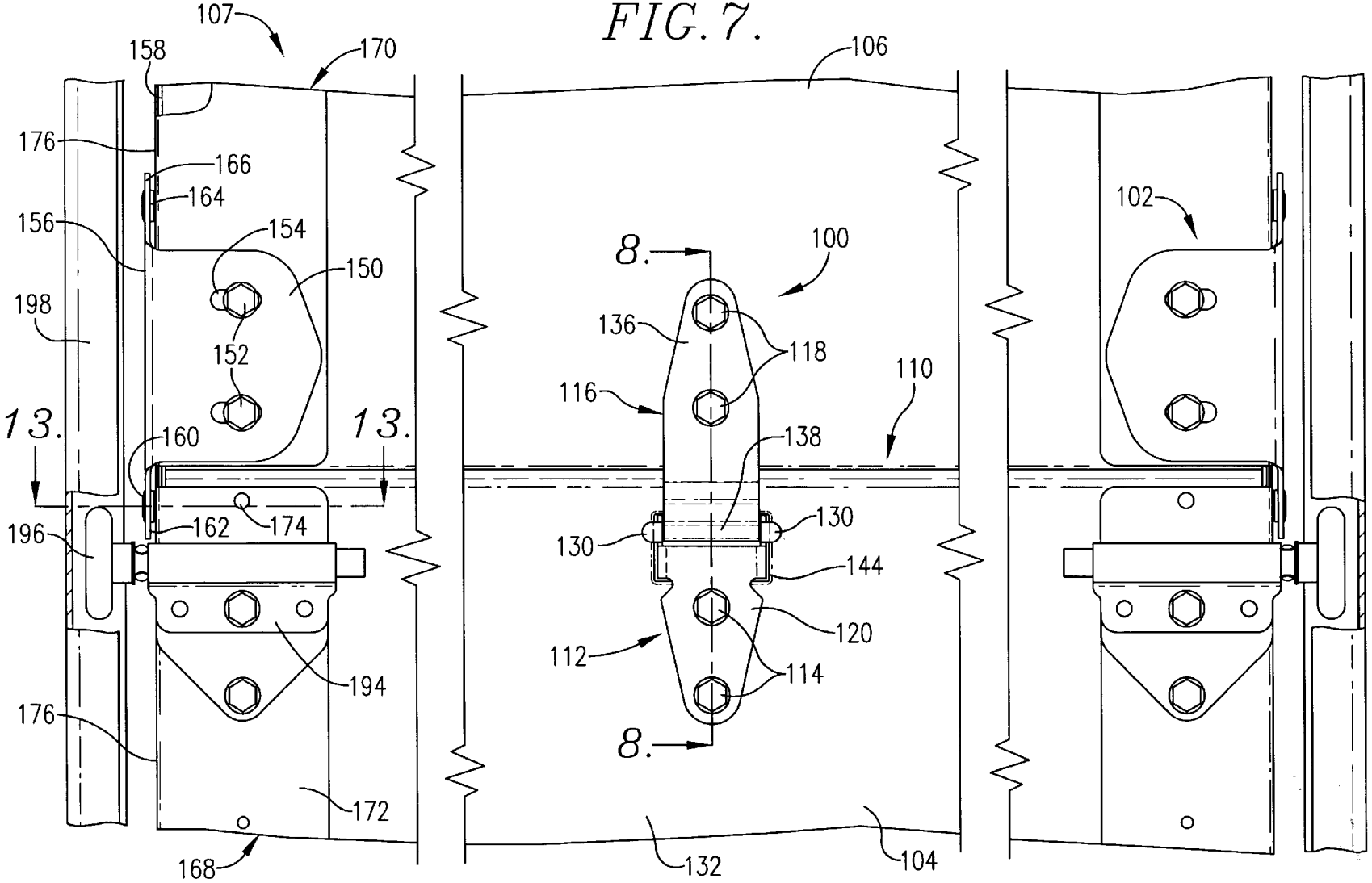
FIG. 7 is a fragmentary rear view of a garage door having alternate center and edge hinge assemblies.

In the alternate embodiment shown in FIG. 7, a central hinge 100 and end hinges 102 are used to connect a first lower panel 104 to an adjacent second upper panel 106 of a segmented garage door 107. A seal 108 is preferably provided in the juncture 110 between the panels 104, 106.

Figure 8:
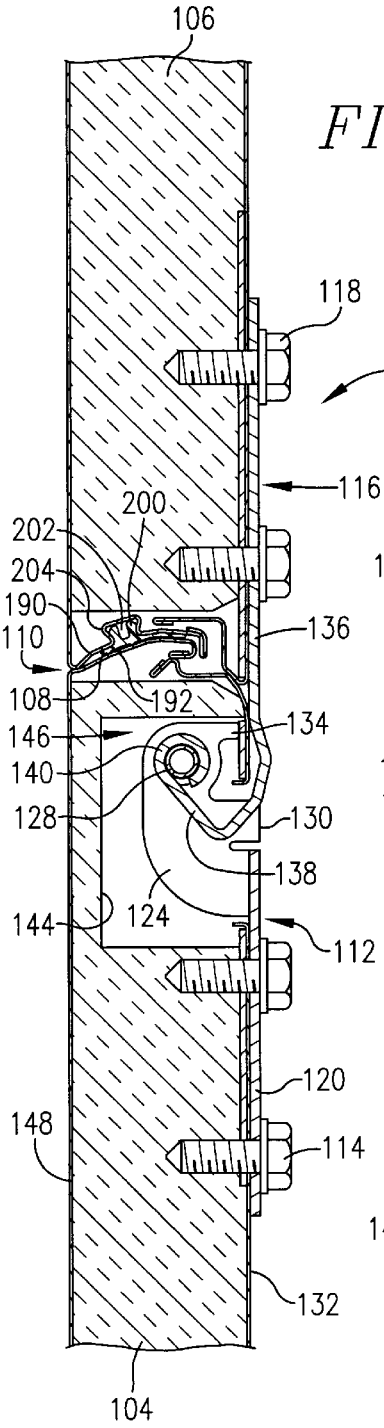
FIG. 8 is a vertical cross-sectional view of the center hinge assembly of FIG. 7 and taken along line 8—8 in FIG. 7.
Figure 9:
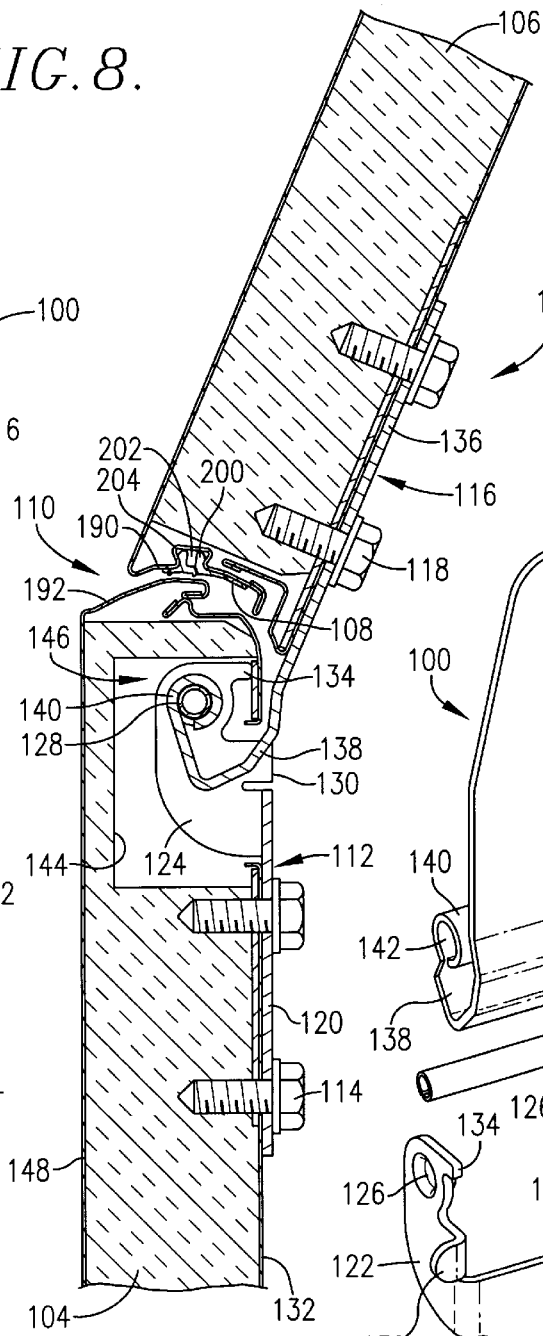
FIG. 9 is a vertical cross-sectional view of the center hinge assembly of FIG. 7 illustrating movement of the hinge.
Figure 10:
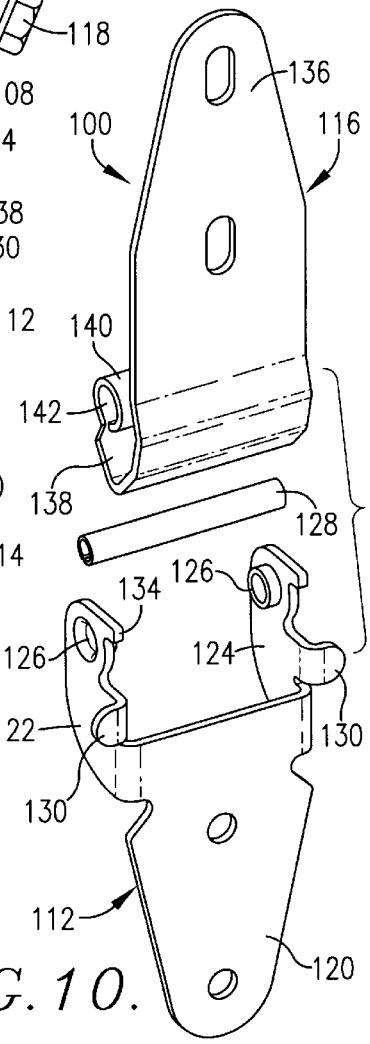
FIG. 10 is an exploded perspective view of the center hinge assembly of FIG. 7.

Referring to FIGS. 8, 9, and 10, the central hinge 100 has a lower hinge bracket 112 mounted on the lower panel 104 with fasteners 114 and an upper hinge brace 116 mounted on the upper panel 106 with fasteners 118. The lower hinge bracket 112 includes a mounting shoe 120 and opposed hinge legs 122, 124 extending transversely from the shoe 120. The legs 122, 124 define hinge pin holes 126 which are in registration to receive a cylindrical hinge pin 128. The hinge bracket also has positioning flanges 130 which extend outwardly from the hinge legs 122, 124 to engage an outer side of an interior wall 132 of the lower panel 104. The opposed flanges 130 are substantially parallel to and planar with the shoe 120, and the flanges 130 are rounded. To further position the hinge bracket 112, positioning feet 134 extend from the hinge legs 122, 124 and engage an inner side of the interior wall 132. The positioning feet 134 are substantially parallel with and planar to the hinge legs 122, 124.

The upper hinge brace 116 includes a mounting plate 136 and a J-shaped hinge arm 138 terminating in a cylindrical loop 140 which defines a hinge pin receiving hole 142 (FIG. 10). The loop 140 is positioned between the hinge legs 122, 124 with the hinge pin receiving hole 142 in registration with the hinge pin holes 126 of the legs. The loop 140 and hinge arm 138 extend substantially perpendicularly to the hinge legs 122, 124. The hinge pin extends through the holes 126, 142 and pivotally couples the hinge bracket 112 to the hinge brace 116. Because the bracket and brace are mounted on the panels 104, 106, the hinge pivotally couples the panels for movement between pivoted and aligned positions.

The hinge legs 122, 124 and the hinge arm 138 extend into a recess 144 in the interior wall 32 of the lower panel 104. The mounting shoe 120 extends over and partially closes the recess 144, and the J-shaped hinge arm 138 extends through the uncovered portion of the recess between the hinge legs. The upper portion 146 of the recess 144 extends behind the interior wall 132, so that the upper portion is hidden behind the interior wall. The hinge legs and arm extend upwardly into the hidden portion 146 of the recess where the positioning feet engage the inner side of the interior wall. Because the hinge pin holes 126 are positioned near the tops of the hinge legs 122, 124, the holes are positioned in the hidden portion 146 of the recess behind the interior wall 132. Thus, the loop 140 and hinge pin 128 are positioned in the hidden portion of the recess behind the interior wall. Because the hinge pin 128 is positioned between the interior wall 132 and an exterior wall 148, that is inside the panel 104 and behind the interior wall 132, the hinge 100 substantially inhibits pinching.

The preferred embodiment of the end hinge 102 is illustrated in FIGS. 11, 12, and 13. The end hinge 102 includes a hinge base 150 mounted on the upper panel 106 by fasteners 152 received in slotted openings 154 in the hinge base 150. A hinge foot 156 extends transversely, preferably perpendicularly, from the hinge base and is positioned adjacent an end 158 of the upper panel 106. A lower pivot pin 160 extends from a lower portion 162 of the hinge foot 156, and an upper mount pin 164 extends from an upper portion 166 of the hinge foot. The upper and lower portions 162, 166 preferably extend beyond the hinge base 150, and the pins 160, 164 are substantially parallel to the hinge base. The lower and upper pins 160, 164 are spaced apart and extend into and engage the lower and upper panels 104, 106, respectively, the lower pivot pin 160 pivotally engages the lower panel 104.

The end hinge 102 also includes a first lower end bracket 168 and a second upper end bracket 170. The end brackets 168, 170 are substantially identical with the respective upper and lower ends illustrated in the Figures, so that an entire end bracket is illustrated. Each mounting bracket has a mounting wall 172 with mounting apertures 174, an end wall 176, and a clamp flange 178. The end wall 176 is substantially perpendicular to the mounting wall 172 and the clamp flange 178, and the clamp flange is opposite and parallel to the mounting wall to clamp the end 158 of the panel therebetween.

The end wall 176 covers the end 158 of the panel, and the end wall of the lower end bracket defines a first, lower pivot opening 180 pivotally receiving the lower pivot pin 160 therethrough. A lower pivot pin recess 182 is formed in the lower panel 104 to receive the pivot pin inside the panel 104. Preferably, a supporting collar 184 is formed around the lower pivot opening 180 to stabilize the lower pivot pin 160. The upper end bracket 170 defines a second, upper pivot opening 186 pivotally receiving the upper pivot pin 164 therethrough. The upper pivot opening 186 is preferably slot shaped. The upper panel 106 also includes a pivot pin recess (not shown) to receive the upper pivot pin 164.

As the panels 104, 106 move between their aligned and pivoted positions, the end hinge does not present any pinch points thereby reducing and inhibiting pinching. To further inhibit pinching, the edges 188, 189 of the end walls are configured similarly to the lower and upper edge walls 190, 192 of the panels 104, 106. It is also advantageous that the pivot pin recesses 182 are smaller than the central hinge recesses 144 to increase the strength of the door panels at their ends.

A guide roller mount 194 is preferably attached to the mounting wall 172 of the end brackets, and a roller wheel 196 is rotatably mounted to the roller mount 194 by a guide roller axle. The roller wheel 196 is rotatably received in a track 198 which guides the garage door 107.

Referring again to FIGS. 8 and 9, the seal 108 is a flexible member interposed between the lower and upper edge walls 190, 192. The seal 108 is preferably configured to mate with both edge walls and includes a compressible dove tail connector 200. The connector defines a connection slit 202 in the wide/top portion of the dove tail. One of the edge walls, preferably the upper edge wall 192, defines a dove tail connection slot 204 configured to receive the dove tail connector 200. The slit 202 allows the wide portion of the dove tail to compress, so that the seal 108 can be pressed directly into the connection slot 204. The seal is securely held by the dove tail connection, and the connection still permits the seal to be easily removed and replaced.

In operation of the segmented garage door 107, the hinge pins 28 and pivot pins 160, 164 are held inside the panels 104, 106. Further, the edge walls 190, 192 of the panels and the edges 188, 189 of the end brackets are configured to reduce if not eliminate pinch points. Thus, the garage door is substantially pinch proof.

Those skilled in the art will appreciate that the present invention encompasses many variations in the preferred embodiment described herein. For example, the preferred door can include any desired number of panels with hinge assemblies spaced as needed at the junctures between adjacent panels. Moreover, the invention encompasses variations in the structure of the hinge assemblies and in the edge walls of adjacent panels so that the pinching hazard is eliminated. Having thus described the preferred embodiment of the present invention, the following is claimed as new and desired to be secured by Letters Patent:

What is claimed is:

1. A segmented door hinge for joining adjacent first and second door panels presenting exterior faces and having a juncture therebetween with mated edge walls on opposed sides of the juncture, the hinge comprising:

a hinge bracket for mounting to the first panel and having a first hinge pin hole therein for positioning adjacent the first panel;

a hinge brace for mounting to the second panel and having a second hinge pin hole therein for positioning adjacent the first panel and in registration with the first hole;

a hinge pin received in the pin holes and pivotally coupling the hinge bracket and hinge brace for movement between a pivoted position and an aligned position, and for pivotally coupling the first and second panels for movement between the pivoted and aligned positions;

said hinge pin for positioning adjacent the first panel, spaced inboard of the exterior face, and spaced from and parallel to the juncture, so that the walls could slide by one another during the movement and matingly engage in the aligned position; and wherein the hinge bracket includes outwardly extending positioning flanges for engaging the first panel exterior surface to position the hinge pin inside the first panel.

2. A segmented door hinge for joining adjacent first and second door panels presenting exterior faces and having a juncture therebetween with mated edge walls on opposed sides of the juncture, the hinge comprising:

a hinge bracket for mounting to the first panel and having a first hinge pin hole therein for positioning adjacent the first panel;

a hinge brace for mounting to the second panel and having a second hinge pin hole therein for positioning adjacent the first panel and in registration with the first hole;

a hinge pin received in the pin holes and pivotally coupling the hinge bracket and hinge brace for movement between a pivoted position and an aligned position, and for pivotally coupling the first and second panels for movement between the pivoted and aligned positions;

said hinge pin for positioning adjacent the first panel, spaced inboard of the exterior face, and spaced from and parallel to the juncture, so that the walls could slide by one another during the movement and matingly engage in the aligned position; and wherein the hinge bracket includes a mounting shoe and a pair of opposed hinge legs extending transversely from the shoe, the first hole being defined through one of the hinge legs, and the other hinge leg defining a third hinge pin hole in registration with the first and second holes.

3. The segmented door hinge according to claim 2 wherein the hinge bracket further includes a pair of positioning feet extending from the hinge legs for engaging an interior side of the first panel and positioning the hinge pin inside the first panel.

4. The segmented door hinge according to claim 2 wherein the hinge brace includes a J-shaped hinge arm terminating in a cylindrical loop defining the second hole, and the J-shaped hinge arm extending between the opposed hinge legs.

5. A segmented door hinge for joining adjacent first and second door panels presenting exterior faces and having a juncture therebetween with mated edge walls on opposed sides of the juncture, the hinge comprising:

a hinge bracket for mounting to the first panel and having a first hinge pin hole therein for positioning adjacent the first panel;

a hinge brace for mounting to the second panel and having a second hinge pin hole therein for positioning adjacent the first panel and in registration with the first hole;

a hinge pin received in the pin holes and pivotally coupling the hinge bracket and hinge brace for movement between a pivoted position and an aligned position, and for pivotally coupling the first and second panels for movement between the pivoted and aligned positions;

said hinge pin for positioning adjacent the first panel, spaced inboard of the exterior face, and spaced from and parallel to the juncture, so that the walls could slide by one another during the movement and matingly engage in the aligned position; and wherein the hinge brace includes a J-shaped hinge arm terminating in a cylindrical loop defining the second hole.

6. A segmented door hinge for joining adjacent first and second door panels presenting exterior faces and having a juncture therebetween with mated edge walls on opposed sides of the juncture, the hinge comprising:

a hinge bracket for mounting to the first panel and having a first hinge pin hole therein for positioning adjacent the first panel;

a hinge brace for mounting to the second panel and having a second hinge pin hole therein for positioning adjacent the first panel and in registration with the first hole;

a hinge pin received in the pin holes and pivotally coupling the hinge bracket and hinge brace for movement between a pivoted position and an aligned position, and for pivotally coupling the first and second panels for movement between the pivoted and aligned positions;

said hinge pin for positioning adjacent the first panel, spaced inboard of the exterior face, and spaced from and parallel to the juncture, so that the walls could slide by one another during the movement and matingly engage in the aligned position; and wherein the hinge bracket includes a mounting shoe for attachment to an interior face of the first panel, and a hinge leg transverse thereto with the first hinge pin hole defined therein, and the hinge brace includes a mounting plate for attachment to an interior face of the second panel and a hinge arm extending from said mounting plate substantially parallel to the hinge leg.

7. A segmented door hinge for joining adjacent first and second door panels presenting exterior faces and having a juncture therebetween with mated edge walls on opposed sides of the juncture, the hinge comprising:

a hinge bracket for mounting to the first panel and having a first hinge pin hole therein for positioning adjacent the first panel;

a hinge brace for mounting to the second panel and having a second hinge pin hole therein for positioning adjacent the first panel and in registration with the first hole;

hinge pin received in the pin holes and pivotally coupling the hinge bracket and hinge brace for movement between a pivoted position and an aligned position, and for pivotally coupling the first and second panels for movement between the pivoted and aligned positions;

said hinge pin for positioning adjacent the first panel, spaced inboard of the exterior face, and spaced from and parallel to the juncture, so that the walls could slide by one another during the movement and matingly engage in the aligned position; and wherein the hinge bracket includes a mounting shoe for attachment to an interior face of the first panel, and a hinge leg transverse thereto with the first hinge pin hole defined therein, and the hinge brace includes a mounting plate for attachment to an interior face of the second panel and a hinge arm extending from said mounting plate substantially perpendicular to the hinge leg.

8. A segmented door hinge for joining adjacent first and second door panels presenting exterior faces, ends, and having a juncture therebetween with mated edge walls on opposed sides of the juncture, the hinge comprising:

a hinge base for mounting to the second panel;

a hinge foot extending from the hinge base and being transverse to the hinge base for being positioned adjacent the ends of the panels;

a pivot pin extending from the hinge foot in a direction substantially parallel to the hinge base for pivotally engaging the first panel, and a mount pin spaced apart from the pivot pin and extending from the hinge foot in a direction substantially parallel to the hinge base for engaging the second panel.

9. The segmented door hinge according to claim 8 wherein the second panel is an upper panel.

10. The segmented door hinge according to claim 8 further comprising a first end bracket for mounting on the end of the first panel, and the first end bracket defining a pivot opening for receiving the pivot pin therein.

11. The segmented door hinge according to claim 8 further comprising a second end bracket for mounting on the end of the second panel, and the second end bracket defining a mount opening for receiving the mount pin therein.

12. The segmented door hinge according to claim 11 wherein the mount opening comprises a slot shaped opening.

13. The segmented door hinge according to claim 8 further comprising a guide roller mount, and a guide roller rotatably mounted by the guide roller.

14. A segmented door comprising:

a plurality of adjacent door panels including adjacent first and second panels with a juncture therebetween and having respective, mated edge walls on opposed sides of the juncture, the panels each presenting an exterior face and ends;

a first segmented door hinge including:

a hinge bracket mounted to the first panel and having a first hinge pin hole therein adjacent the first panel;

a hinge brace mounted to the second panel and having a second hinge pin hole therein positioned adjacent the first panel and in registration with the first hole;

a hinge pin received in the pin holes and pivotally coupling the first and second panels for movement between a pivoted position and an aligned position, and the hinge pin being positioned adjacent the first panel, spaced inboard of the exterior face, and spaced from and parallel to the juncture so that the edge walls slide by one another during the movement and matingly engage in the aligned position; and a second segmented door hinge including:

a hinge base mounted to the second panel;

a hinge foot extending from the hinge base and being transverse to the hinge base and positioned adjacent the ends of the panels;

a first pivot pin extending from the hinge foot in a direction substantially parallel to the hinge base and pivotally engaging the first panel, and a second pivot pin spaced apart from the first pivot pin and extending from the hinge foot in a direction substantially parallel to the hinge base for pivotally engaging the second panel.

15. The segmented door according to claim 14 wherein the first hinge comprises a central hinge.

16. The segmented door according to claim 14 wherein the second hinge comprises an end hinge.

17. The segmented door according to claim 14 wherein the second hinge further comprises a first end bracket mounted on the end of the first panel, and the first end bracket defining a first pivot opening for receiving the first pivot pin therein and a second end bracket mounted on the end of the second panel, and the second end bracket defining a second pivot opening for receiving the second pivot pin therein.

18. The segmented door according to claim 14 wherein the hinge bracket includes a mounting shoe for attachment to an interior face of the first panel, and a hinge leg transverse thereto with the first hinge pin hole defined therein, and the hinge brace includes a mounting plate for attachment to an interior face of the second panel and a hinge arm extending from said mounting plate substantially perpendicular to the hinge leg.

19. The segmented door according to claim 14 wherein the hinge bracket includes a mounting shoe for attachment to an interior face of the first panel, and a hinge leg transverse thereto with the first hinge pin hole defined therein, and the hinge brace includes a mounting plate for attachment to an interior face of the second panel and a hinge arm extending from said mounting plate substantially parallel to the hinge leg.

* * * * *